US007229112B2

(12) United States Patent
Grbic

(10) Patent No.: US 7,229,112 B2
(45) Date of Patent: Jun. 12, 2007

(54) FLEXIBLE CARRIER APPARATUS AND METHOD FOR TRACKING THE SAME

(76) Inventor: George Grbic, 5707 Iris La., Schererville, IN (US) 46375

( * ) Notice: Subject to any disclaimer, the term of this patent is extended or adjusted under 35 U.S.C. 154(b) by 0 days.

(21) Appl. No.: 11/252,227

(22) Filed: Oct. 17, 2005

(65) Prior Publication Data

US 2007/0024071 A1 Feb. 1, 2007

Related U.S. Application Data

(63) Continuation-in-part of application No. 10/354,755, filed on Jan. 30, 2003, now Pat. No. 6,966,589.

(51) Int. Cl.
*A45F 5/10* (2006.01)

(52) U.S. Cl. ..... 294/150; 294/142; 294/154; 294/157

(58) Field of Classification Search ..... 294/137, 294/150, 152–155, 157, 159, 164, 165, 170, 294/82.14, 142; 24/16 R, 17 A, 17 B; 383/16
See application file for complete search history.

(56) References Cited

U.S. PATENT DOCUMENTS 217,230 A * 7/1879 Lyman ..... 294/154
466,670 A * 1/1892 Fler ..... 294/152
471,988 A * 3/1892 Acheson ..... 294/154
2,485,864 A * 10/1949 Cohen et al. ..... 294/156
2,486,827 A * 11/1949 Duncan ..... 294/154
2,927,329 A * 3/1960 Johannis ..... 5/662
3,119,160 A * 1/1964 Hoppeler ..... 24/16 R
3,143,266 A * 8/1964 Imatake ..... 294/152
3,493,154 A * 2/1970 Engle ..... 294/150
4,469,363 A * 9/1984 Kalla ..... 294/154
4,586,745 A * 5/1986 Shepard ..... 294/150
4,699,416 A * 10/1987 Lacey ..... 294/152
4,724,989 A * 2/1988 Silberberg ..... 224/609
5,096,248 A * 3/1992 Ryan ..... 294/156
5,503,448 A * 4/1996 Dewey ..... 294/152
D433,812 S * 11/2000 Newby ..... D3/327
6,511,114 B1 * 1/2003 Fludd ..... 294/159
6,966,589 B1 * 11/2005 Grbic ..... 294/150

* cited by examiner

*Primary Examiner*—Dean J. Kramer
(74) *Attorney, Agent, or Firm*—Patula & Associates, P.C.

(57) ABSTRACT

A flexible carrier apparatus comprising two rods and two flexible straps. The flexible straps are attached at opposite ends of the rods. One rod is placed under and then above the other rod, thus creating two nooses from the flexible straps, used to carry objects. A netting portion spanning the flexible straps is used to carry smaller objects. A securing device may be used to hold the objects together when the apparatus is not being carrier. A holding device may be used to hold the apparatus in position to receive objects.

13 Claims, 9 Drawing Sheets

FLEXIBLE CARRIER APPARATUS AND METHOD FOR TRACKING THE SAME

This application is a Continuation-In-Part of U.S. Non-Provisional Patent Application entitled "Flexible Carrier Apparatus and Method for Tracking the Same" filed Jan. 30, 2003 and assigned U.S. application Ser. No. 10/354,755 now U.S. Pat. No. 6,966,589, the entire disclosure of which is hereby herein incorporated by reference.

The present disclosure relates generally to the field of bundling, carrying and storing of objects, and more particularly, to carrying devices with flexible straps. Specifically, the present disclosure is a carrying device having two generally parallel rods or handles connected with two independent flexible straps. The carrying device is configured in such a way as to create two self-tightening nooses which facilitate the bundling, carrying and storing attributes of the invention.

BACKGROUND OF THE INVENTION

In the past, in order to move a bundle of objects, the bundle typically had to be manually tied together such that the unified bundle could be carried by hand. Examples of such objects include blue prints, fishing poles, clothing to be laundered, firewood, etc. The user would then carry the unified bundle by hand. When the unified bundle reached its destination, the user would then have to untie or cut the rope in order to release the individual objects from the bundle. Therefore, if the user wanted to move the remaining individual objects again, he would have to repeat the process of retying the rope or twine.

This process is very inefficient because of the time it takes to tie and untie the rope. In addition, there is the possibility that an individual object may accidentally fall out of the unified bundle causing the user to retie the individual objects again. Also, tying the bundle is inefficient because when the user desires to remove one individual object from the unified bundle, the rope would have to be untied in order to facilitate removal.

Also, once the unified bundle is dropped off at a location, it is often quite difficult to keep track of its location and identification. For example, if a unified bundle of laundry is dropped off at a laundry service establishment, quite often the establishment's employees need to individually mark each bundled item for tracking and identification purposes. This becomes quite tedious because the unified bundle must be separated in order to properly mark each item.

Accordingly, there is a need for a flexible carrying apparatus and method for tracking the same which is fast and easy to use, which is sturdy and strong, and which can universally carry different sized and shaped objects, and various configurations and amounts of such objects. The present invention fulfills such a need, and provides numerous other benefits and advantages in carrying apparatus.

BRIEF SUMMARY OF THE INVENTION

The present disclosure relates to an improved, flexible and universal carrying device which facilitates the bundling, transporting and storing one or more objects. The preferred embodiment entails the use of two flexible straps. Both straps are attached at one end to opposite ends of a rod or handle. The remaining ends of the flexible straps are fixedly attached to the opposite ends of a second rod or handle, preferably being of slightly less length than the first rod or handle.

The second rod is placed under and around the first rod, whereby creating a noose with each flexible strap. Elongated objects such as fishing rods, firewood, blue prints, items to be laundered, or the like, are placed within the nooses. Shorter objects which do not span the nooses, such as books, balls, tools, cans, etc., may be placed on a netting portion such as a shroud, mesh or netting spanning between the two straps.

When the second rod is lifted vertically, the weight of the objects thus causes the nooses of the flexible straps, or the shroud, mess or netting, to automatically tighten around the objects. The objects can then be easily carried to their destination. When it is desired to remove an individual object from the bundle, the second rod is lowered until the objects' weight is displaced by a bottom force, such as the ground or a flat table, thus relieving the tension in the flexible straps and loosening the noose.

The preferred embodiment further entails a means for identifying the carrier apparatus for easy tracking. In the preferred embodiment, the means for identifying the carrier apparatus entails the use of marking the apparatus with a bar code used in connection with a bar code reading system to facilitate easy tracking and identification. Alternate embodiments of the present invention use a tagging means, a marking means, global positioning means and the like to facilitate tracking and identification. It should be understood, however, that any type of identification or tracking method can be effectively utilized to identify or track the carrier apparatus. As such, it is to be understood that the above-described examples should not limit the scope or spirit of the present invention.

Further, the carrier device may include a means for securing the device with objects therein, when not being carried. For example, hook and loop type fasteners or other securing devices could be suitably located along the straps, such that the nooses can be fixed in position to prevent the objects from being displaced from the carrier device when not being carried.

Also, the carrier device can be placed into a means for holding the carrier device in a position to receive objects, such as for example a rack or other suitable container. Objects can then easily be placed in the carrier device without having to manipulate the carrier device. The carrier device can then simply be lifted from the means for holding to transport the objects.

Accordingly, it is the principal object of the present disclosure to provide a universal carrier apparatus for facilitating bundling, transporting and storing of one or more objects of different sizes and shapes, and various configurations and amounts of such objects.

It is a further object of the present disclosure to provide a re-usable, self-tightening apparatus that can be easily and conveniently closed and opened for the securing therein and the removal therefrom of one or more objects.

It is also an object of the present disclosure to provide a means of identifying or tagging the carrier apparatus for easy tracking and identification.

It is another object of the present disclosure to provide a means for securing the device with objects therein, when not being carried, and a means for holding the device in a position to receive objects.

It is an additional object of the present disclosure to provide a carrying apparatus which automatically tightens around or secures one or more objects by displacing the weight of the one or more objects.

Numerous other advantages and features of the disclosure will become readily apparent from the following detailed description, from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE DISCLOSED EMBODIMENT

Figure 1:
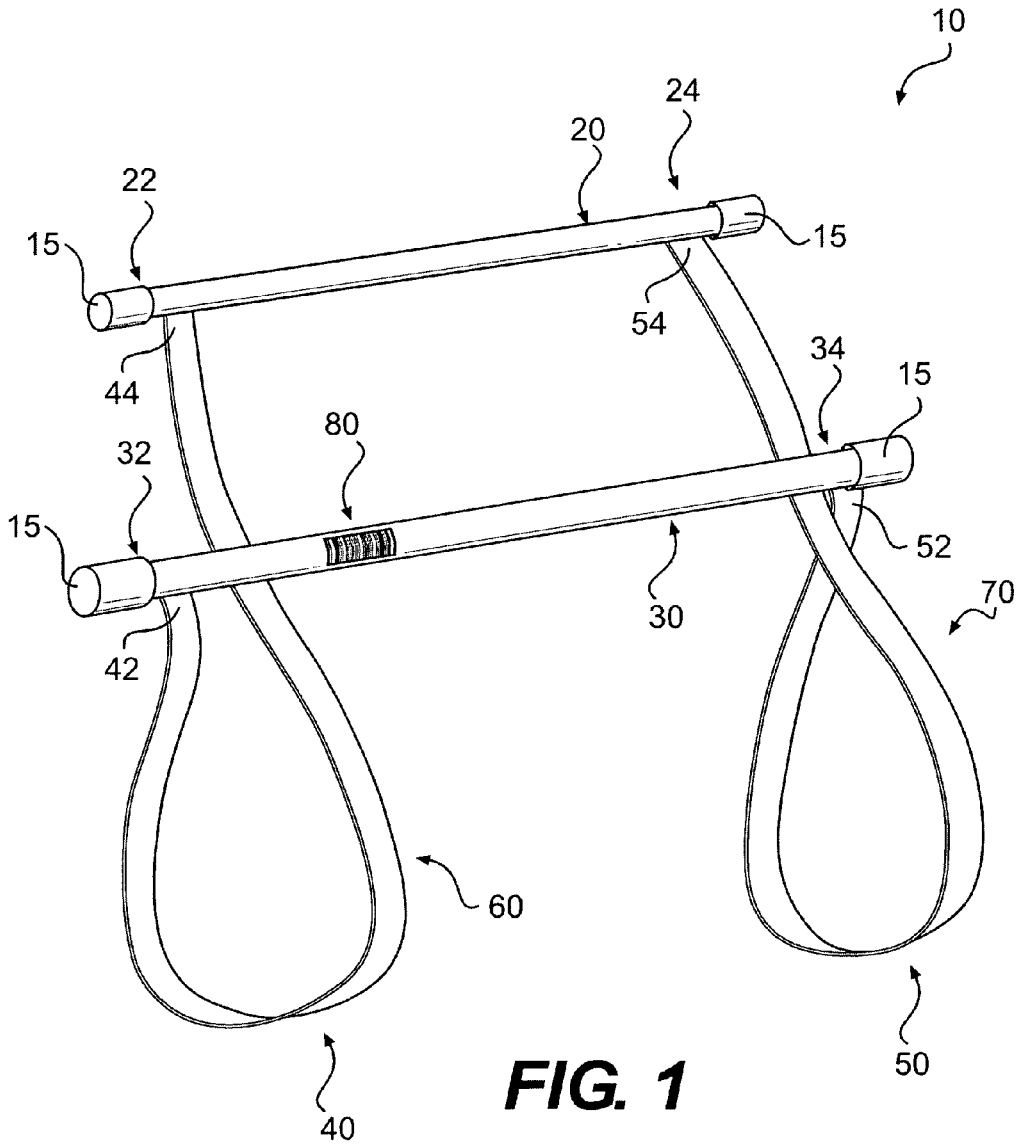
FIG. 1 is a perspective view of the flexible carrier apparatus showing the apparatus with noosing configuration enabled.

While the invention is susceptible of embodiment in many different forms, there is shown in the drawings and will be described herein in detail one or more embodiments of the present disclosure. It should be understood, however, that the present disclosure is to be considered an exemplification of the principles of the invention, and the embodiment(s) illustrated is/are not intended to limit the spirit and scope of the invention and/or the claims herein.

Referring to FIG. 1, a preferred embodiment of the present invention 10 contains two rods 20 and 30. Rods 20 and 30 could take any suitable form and could be made from any suitable material. Preferably, the rods 20 and 30 are rigid or semi-rigid rods. The rods can be constructed of any suitable material, such as a metallic base material, plastic, wood, etc. Within the preferred embodiment, rod 20 is shorter than rod 30 to facilitate the ease of self-noosing the apparatus. Alternatively, the rods could be the same length. The preferred embodiment of the present invention further provides end caps 15 for safety purposes to ensure that the ends of rods 20 and 30 are not sharp.

The preferred embodiment of the present invention also comprises two flexible straps 40 and 50, preferably of equal length. The flexible straps can be constructed of any flexible material such as rubber, plastic, fabric, leather, canvas, and the like. Within the preferred embodiment, one end 42, 52 respectively of flexible straps 40 and 50 are suitably attached or fastened at opposite ends 32, 34 of rod 30. Each strap 40, 50 is attached to a respective end 32, 34 of rod 30 whereby a fixed distance separates them. It is foreseen however that the straps 40 and 50 could be adjustably attached to the rods 20 and 30 in any suitable manner to allow the distance between the straps 40 and 50 to be adjustable. The other ends 44, 54 respectively of the flexible straps 40 and 50 are attached to the opposite ends 22, 24 of the other rod 20. Each opposite end 44, 54 of the flexible straps 40, 50 respectively are attached to a respective end 22, 24 of rod 20 whereby they are separated by a fixed distance. Again, adjustability is foreseen.

A self-tightening noose 60, 70 is created with each of the flexible straps 40 and 50 by placing rod 20 under and then above rod 30. Elongated items, such as fishing poles, blue prints, items to be laundered, firewood and the like, are placed in the self-tightening nooses. When rod 20 is lifted vertically, thus displacing the weight of the individual elongated items, the self-tightening noose size is automatically decreased, thus ensuring a tight, secure fit around the bundled elongated items.

Rod 20 is subsequently used as a carrying handle to facilitate the transportation of the flexible carrier apparatus and contained elongated items. When it is desired to remove one, some or all of the elongated items from the self-tightening nooses, rod 20 is lowered until the weight of the individual elongated items is displaced by a surface, preferably flat, such as the ground or a flat table. The weight displacement will automatically decrease the tension in flexible straps 40 and 50, thus loosening the self-tightening nooses to facilitate item removal.

The preferred embodiment further entails a means 80 for identifying the carrier apparatus for easy tracking, for example in a laundry service establishment. In the preferred embodiment, the means 80 for identifying the carrier apparatus entails the use of marking the apparatus with a bar code and utilizing a bar code reading system to facilitate easy tracking and identification. The bar code can identify a user and be linked to a database storing specific information regarding that user, such as name, address, preferences in dry cleaning (e.g., starch, box or hanger, etc.), dates for pickup (e.g., every Friday), billing preferences (e.g., credit card, cash), etc. In this manner, the user could simply drop off the carrier apparatus full of dirty laundry, and pick it up on the pre-established pick-up date along with the laundry cleaned and presented according to pre-established preferences, thus eliminating the potential for errors from miscommunication, etc., and saving the user and the laundry service provider substantial time and effort from drop-off to pick-up.

Figure 4:
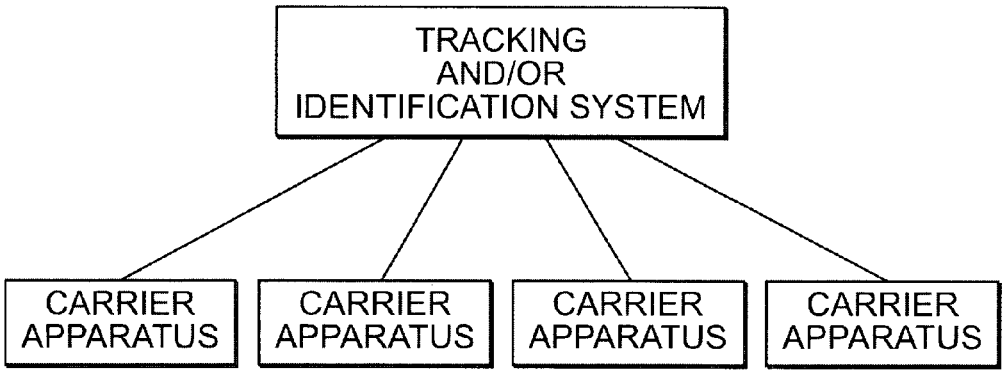
FIG. 4 is a schematic diagram of the tracking and/or identification system of the present disclosure.

A schematic diagram of the tracking and/or identification system described herein is illustrated generally in FIG. 4. The tracking system could take the form of, for example, a GPS system.

Alternate embodiments of the present invention use a means for marking or tagging to facilitate tracking and identification. It is to be understood, however, that any type of identification or tracking method can be effectively utilized to identify or track the carrier apparatus. As such, it is to be understood that the above-described examples should not limit the scope or spirit of the present disclosure.

Figure 3:
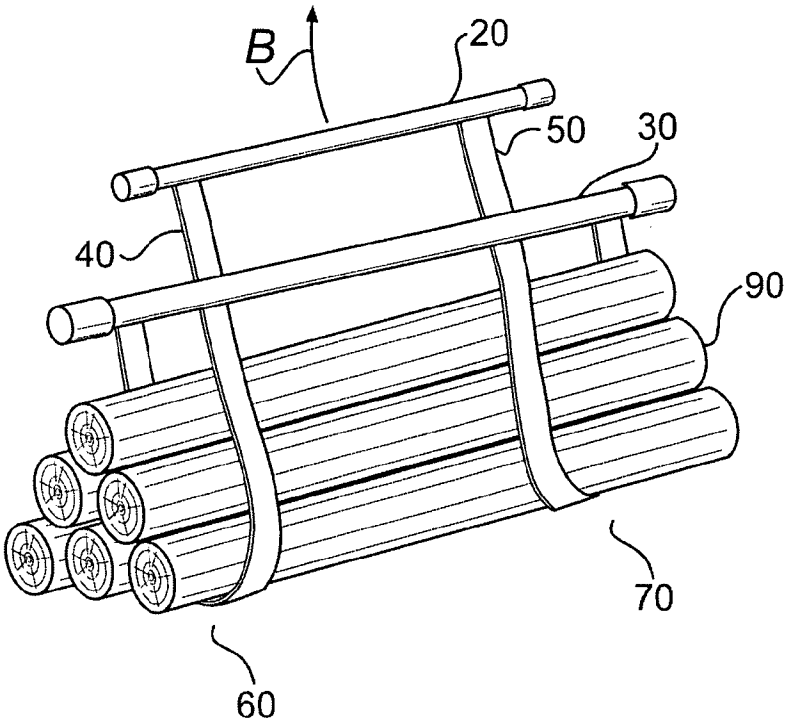
FIG. 3 is a perspective view of the flexible carrier apparatus positioned to transport objects.
Figure 2:
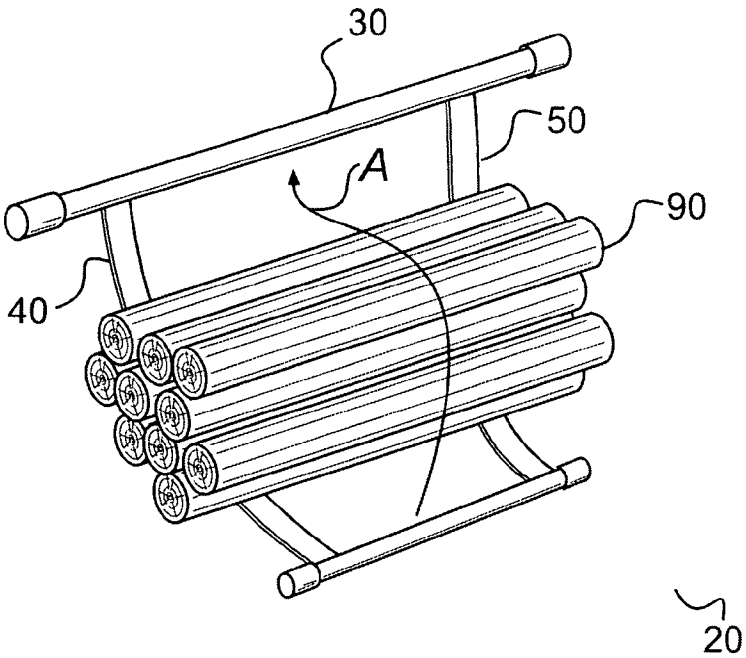
FIG. 2 is a perspective view of the flexible carrier apparatus being loaded with objects.

FIGS. 2 and 3 illustrate the present invention 10 in use. As shown in FIG. 2, objects 90 to be carried are placed upon the flexible straps 40 and 50 with the rods 20, 30 spaced apart. A self-tightening noose 60, 70 is created with each of the flexible straps 40 and 50 by placing rod 20 under and then above rod 30 as indicated by the direction of Arrow A. This results in the configuration shown in FIG. 3. When rod 20 is lifted vertically, as indicated by the direction of Arrow B in FIG. 3, the weight of the individual elongated items is displaced and the self-tightening noose size is automatically decrease, thus ensuring a tight, secure fit of each noose around the bundled elongated items, regardless of variations in the size of the bundled items at each noose.

Depending on the relative lengths of the rods 20, 30, the placement of one rod under and then above the other could be achieved by a simple angling of one of the rods or both rods. Further, the straps 40 and 50 could be fixed to the rods 20 and 30, or could be removably and adjustably attached thereto via any suitable means such as buckles, hooks and eyelets, hook and loop type fasteners, etc.

Still further, for longer items such as piping, branches, lumber, etc., additional nooses may be added. For example, rod 30 could be of greater length, and have four straps attached thereto. Two of the straps on one half of rod 30 could attach to a first rod 20, while the other two straps on the other half of rod 30 could be attach to a second rod 20. Four nooses could then be formed as described, with the resulting carrier having two handles. Alternatively, two separate carriers could be used on longer bundles.

Figure 5:
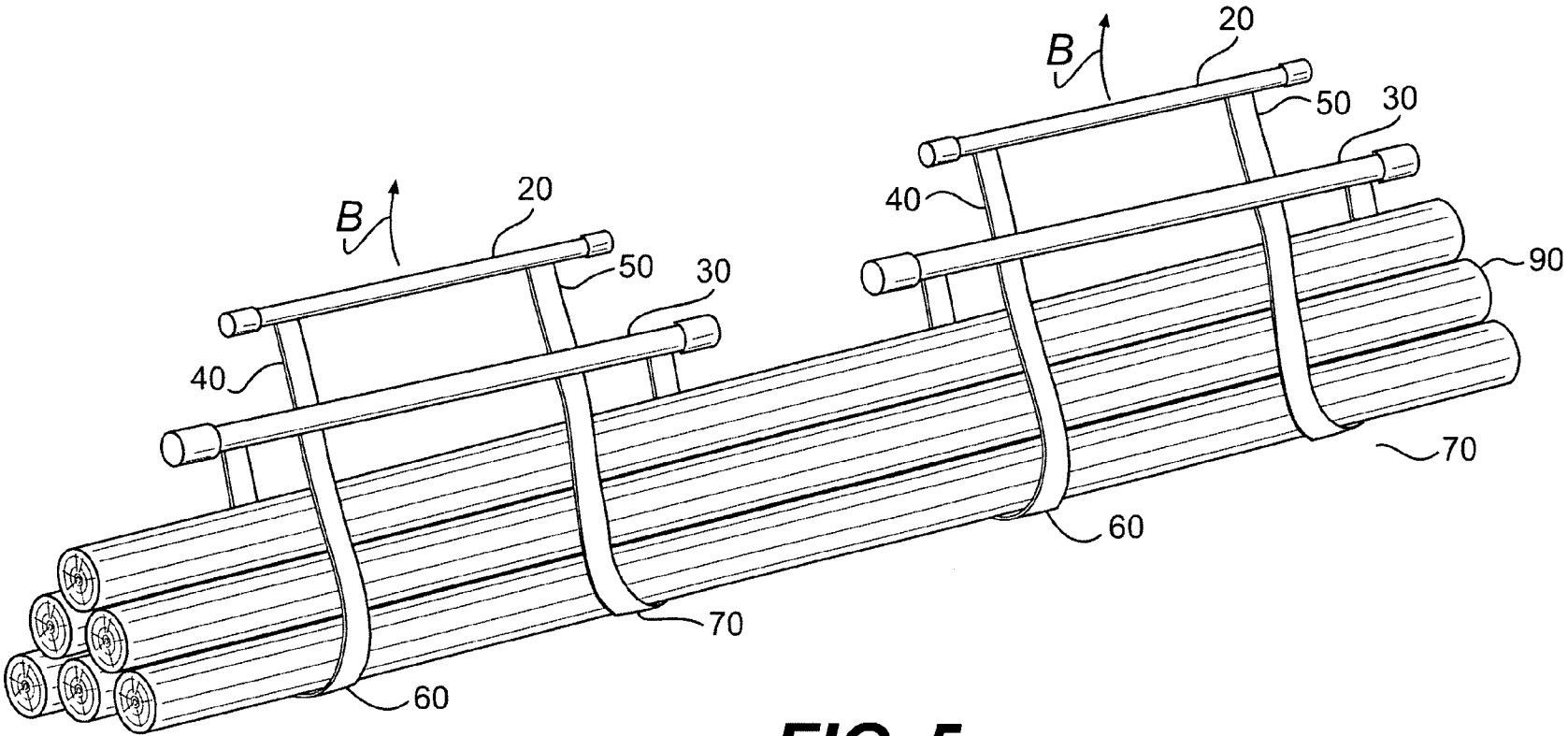
FIG. 5 is a perspective view of two flexible carrier apparatuses positioned to transport objects.

FIG. 5 illustrates the use of two carriers on a longer bundle, as discussed above. Use of the carrier(s) in this manner allows two users to easily carry elongated objects such as logs or lumber. The material use for the rods and the straps should be strong enough to be able to support heavy loads without breaking or otherwise failing, and all connections could be suitable reinforced. Again, it should be understood that the two rods 30 could be replaced by a single elongated rod.

Figure 6:
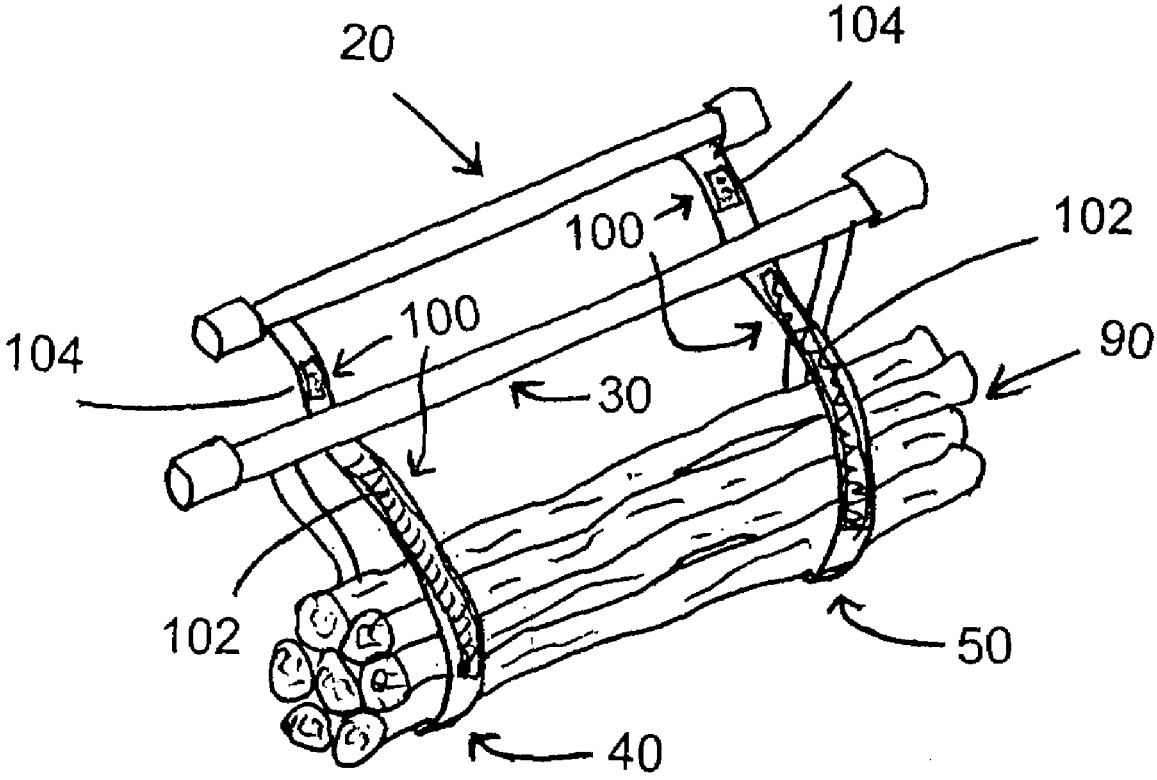
FIG. 6 is a perspective view of the flexible carrier apparatus having a securing device on the straps.

FIG. 6 is a perspective view of the flexible carrier apparatus having a securing device 100 on the straps. Specifically, securing device 100 takes the form of complimentary hook and loop type fasteners 102 and 104. As can be seen in FIG. 6, an elongated patch or long strip 102 of hook/loop type fasteners are suitable attached to straps 40 and 50, such as by stitching. Preferably, the strip 102 runs at least half the length of the straps 40 and 50, from rod 30 towards rod 20. Proximate rod 20, a smaller strip or patch 104 of hook/loop type fasteners are suitably attached to straps 40 and 50. It should be under stood that strips 102 and strips 104 are complimentary to each other such that they selectively fasten together as is know in the art of hook and loop type fasteners.

Accordingly, to secure the bundle of objects 90 when not being carried, rod 20 is moved over and around rod 30 and toward and around objects 90, until strap 40 and strap 50 overlap themselves. When the straps overlap as described, smaller strip 104 will contact a portion of longer strip 102 and fasten together, thereby preventing slack to form in the straps 40 and 50, and holding the bundle of objects tightly together, even when the carrier is not being held. This allows a user to place the carrier down as desired without the bundle of objects separating and potentially falling from or escaping the carrier.

It is foreseen that the long strip 102 may not be a continuous strip, but could be a series of strips having small gaps there between. Further, it is foreseen that other suitable complimentary fasteners such as snaps, buttons, or hooks could be used in place of the hook/loop type fasteners.

Figure 7:
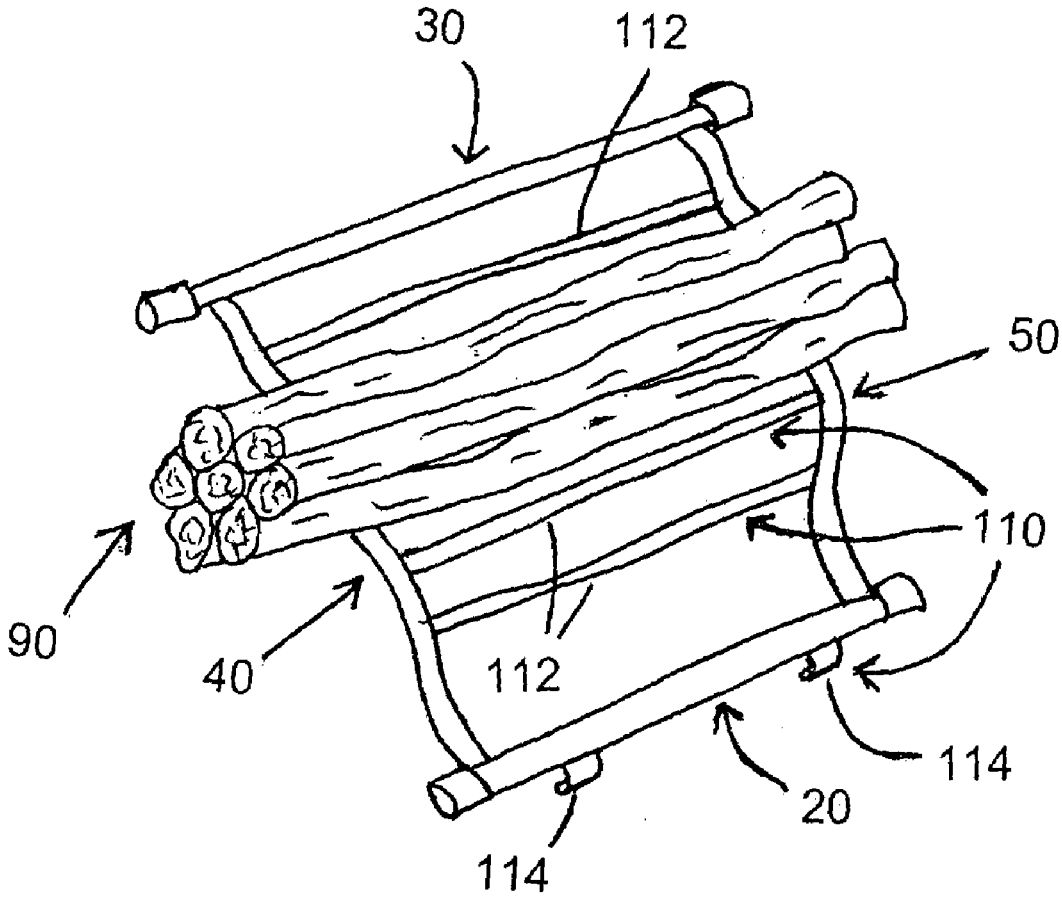
FIG. 7 is a perspective view of the flexible carrier apparatus having an alternate securing device.

FIG. 7 is a perspective view of the flexible carrier apparatus having an alternate securing device. In this embodiment, securing device 110 takes the form of a plurality of cross straps 112 which may be engaged by one or more hooks or other suitable strap engaging elements 114 attached to rod 20. Preferably, the cross straps 112 are spaced apart at short intervals along at least half the length of the straps 40 and 50, from rod 30 towards rod 20. Attached to rod 20 is one or more hooks 114 (two shown) for engaging one of the cross straps 112. It should be understood that securing device 110 could take any suitable form so long as it functions to remove slack in the straps 40 and 50, and to prevent the load from loosening.

Accordingly, to secure the bundle of objects 90 when not being carried, rod 20 is first moved under and then above rod 30 to its carrying position (position shown in FIG. 6), and then is moved over and around rod 30 and toward and around objects 90, until hooks 114 are near the farthest cross strap 112 they can reach. Hooks 114 are hooked onto that cross strap 112, thereby preventing slack to form in the straps 40 and 50, and holding the bundle of objects tightly together, even when the carrier is not being held. Cross straps 112 are preferably elastic or flexible such that they may stretch slightly to allow the chosen cross strap 112 to reach the hooks 114, as should be understood. Alternatively, each hook 114 may be connected to rod 20 via an elastic band or bungie cord, which could stretch to allow the hook 114 to reach the appropriate cross strap 112.

Figure 8:
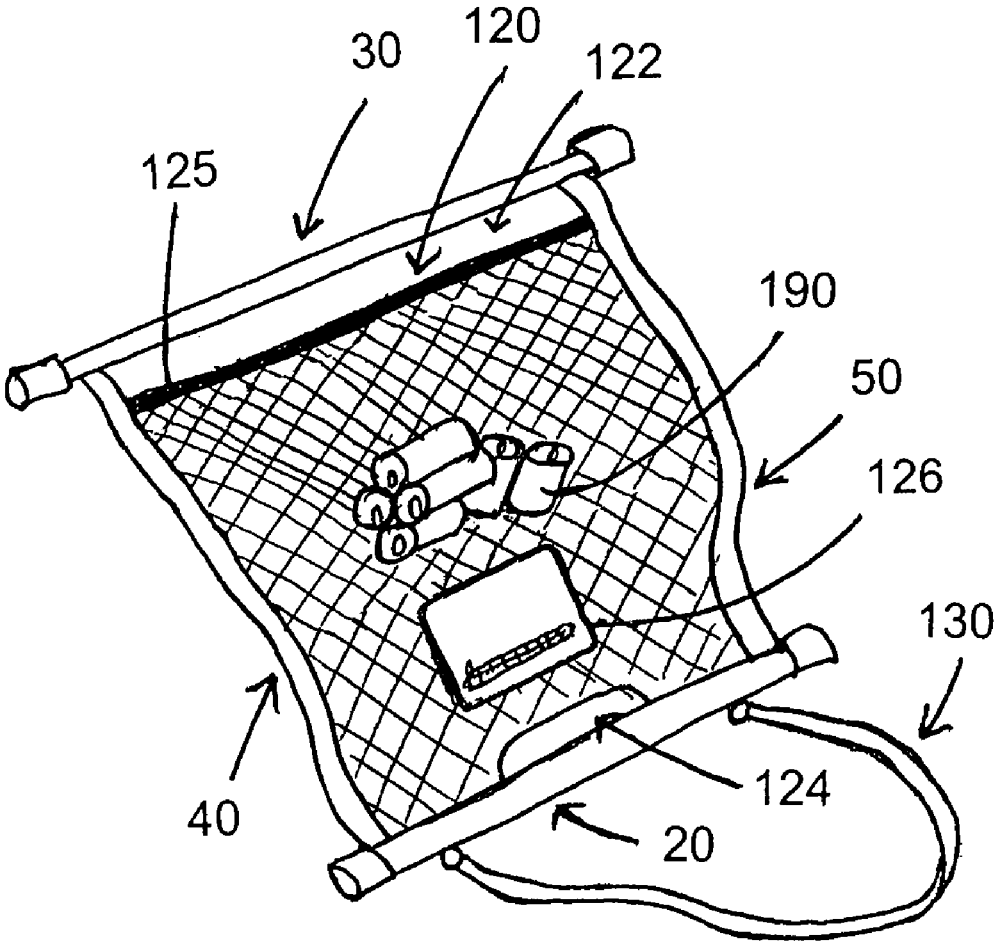
FIG. 8 is a perspective view of the flexible carrier apparatus having a netting portion.

FIG. 8 is a perspective view of the flexible carrier apparatus having a netting portion 120. As before, straps 40 and 50 are connected to rods 20 and 30. However, a netting portion 120 spans between and is suitably attached to straps 40 and 50, and preferably to a portion of rod 20, as illustrated. It should be understood that the terms "netting portion" are used to describe any portion, section or device spanning between the straps 40 and 50 for the purpose of holding items to be carried, and could take any suitable form, shape, material, etc.

Netting portion 120 does not extend to rod 30, and instead any suitable space 122 is left between the edge of the netting portion 120 and rod 30 so as to allow rod 20 to pass through space 122. Further, as can be seen, a space 124 is preferably provided in netting portion 120 near rod 20 to allow the user's hand to grip and lift rod 20 without interference from the netting portion 120. It should be understood that the netting portion 120 need not attach to rod 20, but could be spaced from rod in the same or similar fashion as space 122.

Additionally, a rigid bar or flat bar or any other suitable rigid or semi-rigid device 125, of any suitable material such as plastic or metal or thick fabric, is preferably located across the top edge of the netting portion 120. This device 125 could take any suitable form or shape. For example, the bar could be C-shaped wherein the ends of the bar curve up and are attached to the rod 30. This device 125 is used to facilitate the positioning of the carrier apparatus of FIG. 8 from its opened, loading position to its closed, carrying position, and to provide structural integrity to the carrier apparatus of FIG. 8 while in use.

Netting portion 120 could be any suitable material to accomplish the purpose of holding smaller items in the carrier apparatus. For example, the netting portion could be rope, canvas, fabric, cloth, elastic mesh, or any other suitable material. The netting portion could be one solid piece of material, or could have a plurality of small openings as illustrated. Preferably, netting portion 120, whether solid or mesh, is elastic, flexible or stretchable such that it will expand around objects placed thereupon, when the carrier is in use. A pocket or similar storage device 126 of any size, shape or material may be suitably affixed in or attached to the netting portion 120, in any suitable location, to receive any small items such as pens, pencils, coins, keys, a calculator, etc. A zipper or other suitable closure is provided in the storage device 126.

Accordingly, in use, smaller objects 190 such as cans, shorter articles of clothing such as socks, undergarments hankies, scarves, etc., or any small objects desired to be carried, are placed on netting portion 120. Rod 20 is placed through space 122, under rod 30, and then lifted above rod 30. As rod 20 is lifted, the self-tightening nooses formed in straps 40 and 50 tighten, and the netting portion 120 encloses around the smaller objects. As the self-tightening nooses tighten to their fullest extent, netting portion 120 preferably stretches around the objects, and then sags slightly under the weight of the objects 190, thereby snugly entrapping the objects 190 in the carrier apparatus. An optional carrying strap 130 can be suitably attached to rod 20. The carrying strap 130 could be placed over the user's shoulder to allow hands free carrying of the carrier apparatus and items therein.

The netting portion 120 thus allows the carrier apparatus to function similar to a bag in that it can carry a plurality of small objects, yet it remains more flexible, convenient, durable and easier to carry than a bag. Further this embodiment is readily portable, reusable and is extremely quick and easy to use for any carrying purpose. Still further, it should be understood that both elongated objects extending past straps 40 and 50 and smaller objects in the netting portion 120 could be carried at the same time. In the embodiment of FIG. 8, the straps are preferably made of at least somewhat elastic material to provide more carrying flexibility for different sized and shaped cargo loads.

Additionally, the netting portion and straps and rods can be made of water proof or water resistant material, such that the carrier apparatus can carry wet objects, such as sweaty clothing, wet beach towels, swimsuits, etc., without damaging the carrier apparatus. The carrier apparatus could be easily rinsed and would not become wet, dirty or smelly itself.

Figure 9:
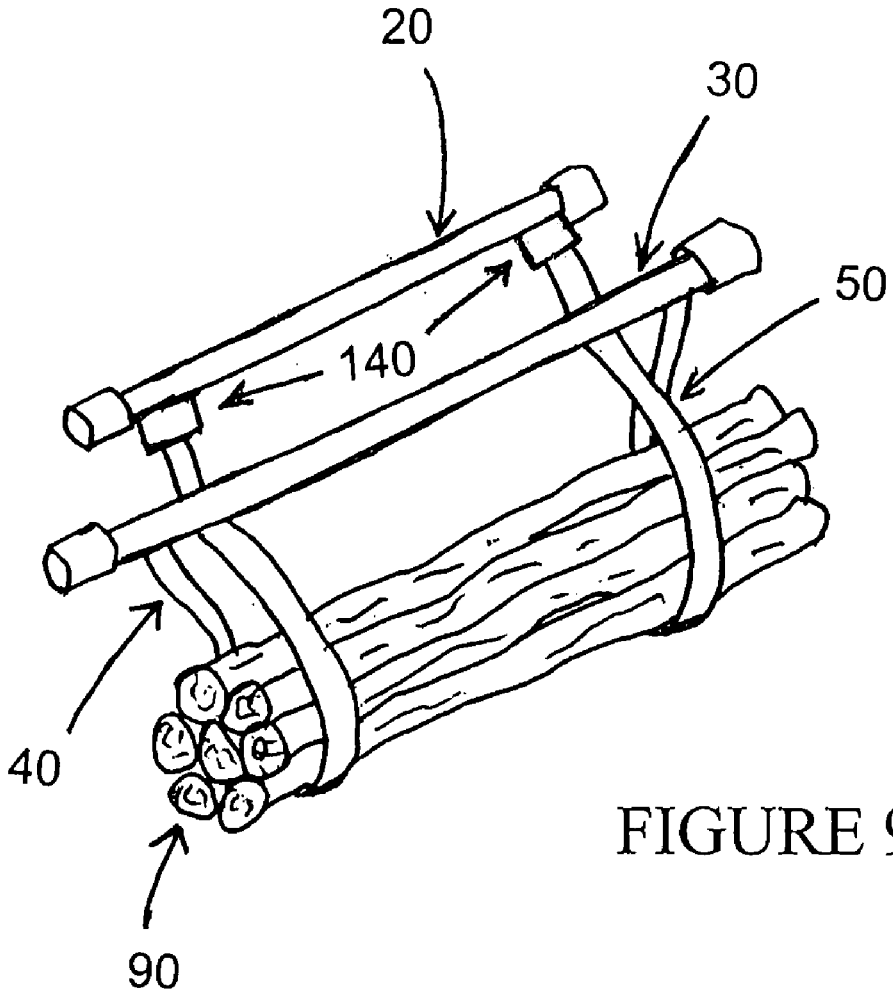
FIG. 9 is a perspective view of the flexible carrier apparatus having an adjustment mechanism for the straps.

FIG. 9 is a perspective view of the flexible carrier apparatus having an adjustment mechanism, schematically illustrated generally as reference number 140. The adjustment mechanism 140 is shown suitably attached to rod 20, but could be integrally incorporated into rod 20 and/or rod 30. In this embodiment, straps 40 and 50 are connected at one end to the adjustment mechanism 140. Adjustment mechanism is used to adjust the length of the straps 40 and 50 to a desired length for any desired lifting or carrying situation. Adjustment of the length of the straps is made via the adjustment mechanism according to the particular form of adjustment mechanism used, as discussed below.

For example, adjustment mechanism 140 could take the form of a lockable, retractable cord device such as those commonly used in dog leashes or the like, wherein the cord is easily pulled to extend or given slack to retract while in an unlocked position, and is fixed at a certain length while in a locked position by a manipulating a locking element. Alternatively, adjustment mechanism 140 could take the form of a buckle device such as those commonly used in air plane seat belts or the like, wherein a free end of the cord or belt is easily pulled through the buckle to shorten the length of the belt, which is prevented from loosening by the buckle, and wherein a latch is lifted to allow the cord to travel the opposite direction through the buckle to extend the length of the belt. In this manner, the length of straps 40 and 50 can be adjusted as desired according to the particular carrying situation and the particular objects being carried.

Figure 10:
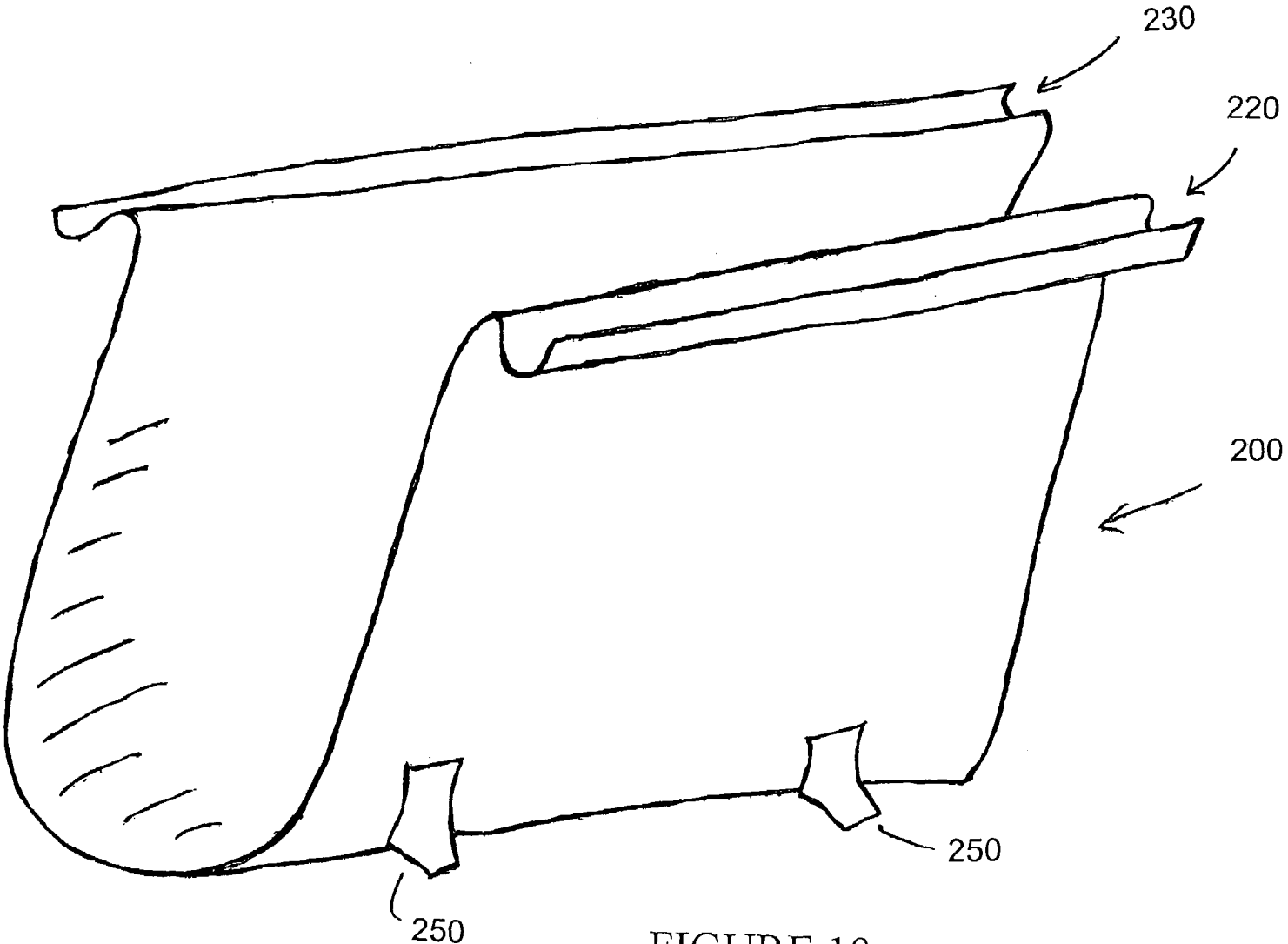
FIG. 10 is a perspective view of a holding device for the flexible carrier apparatus.

Referring now to FIG. 10, a perspective view of a holding device 200 for the flexible carrier apparatus is illustrated. The holding device 200 is a generally U-shaped structure having two rod holders 220 and 230 at the top of the U-shaped structure. A plurality of feet 250 may be attached at the bottom of the U-shaped structure to support the same in an upright position. Notches (not shown) could be formed in the sides of the U-shaped structure for receiving the straps 40 and 50 and preventing lateral movement thereof relative to the holding device.

In use, rod 20 is placed in rod holder 220 and rod 30 is placed in rod holder 230. Straps 40 and 50 extend into holding device 200, lying against the interior sides and/or bottom of the generally U-shaped structure. Objects such as shirts to be laundered are then simply thrown into the holding device lengthwise, such that the objects extend across straps 40 and 50. When the user desires to lift and carry the objects, the rods 20 and 30 are simply lifted from the rod holders 22 and 230 respectively, and rod 20 is placed under and then above rod 30. The user then holds and lifts rod 20 to carry the objects.

It should be understood that holding device could take any suitable shape so long as it accomplishes the purpose of holding the rods apart and allowing objects to accumulate in the carrier apparatus. For example, the holding device 200 could simply be four arms extending up from a base, wherein each rod rest in grooves on the tops of two arms. Additionally, the holding device may include an air freshening element (not shown) which would mask or eliminate any odor from objects placed in the carrying apparatus, such as dirty laundry. The air freshening element may take any suitable form known in the art of air fresheners, and may attach to or be integral with the holding device.

It is to be understood that the embodiment(s) herein described is/are merely illustrative of the principles of the present invention. Various modifications may be made by those skilled in the art without departing from the spirit or scope of the claims which follow. For example, any of the different features described above with reference to any of the drawings can be combined with any other features or used on any of the embodiments disclosed herein. For example, the straps of the embodiment illustrated in FIG. 8 could have the securing device as shown and described in FIG. 6. Alternatively, the hooks 114 of FIG. 7 could be adapted to engage the netting portion 120 of FIG. 8. All other combinations and other modifications are contemplated.

What is claimed is:

1. A carrier apparatus comprising:

a first rod;

a second rod;

a first strap connecting the first and second rods;

a second strap connecting the first and second rods;

wherein the carrier apparatus is in a carrying position when the first rod is placed under and then above the second rod to form two self-tightening nooses from the first and second straps; and a securing device selectively preventing the nooses from loosening, wherein the securing device comprises hook and loop type fasteners on at least one of the first and second straps, and wherein the at least one of the first and second straps is doubled over to engage the hook and loop type fasteners.

2. The apparatus of claim 1, further comprising an adjustment mechanism for slideably adjusting the length of the straps.

3. The apparatus of claim 2, wherein the adjustment mechanism is a lockable retracting device.

4. The apparatus of claim 2, wherein the adjustment mechanism is a pull through buckle device with a release latch.

5. A carrier apparatus comprising:

a first rod;

a second rod;

a first strap connecting the first and second rods;

a second strap connecting the first and second rods;

wherein the carrier apparatus is in a carrying position when the first rod is placed under and then above the second rod to form two self-tightening nooses from the first and second straps; and a netting portion spanning the first and second straps, for the purpose of holding small items.

6. The apparatus of claim 5, wherein the netting portion is elastic mesh.

7. The apparatus of claim 5, wherein a space is provided between the netting portion and the second rod such that the first rod can pass between the second rod and the netting portion.

8. The apparatus of claim 5, wherein a space is provided between the netting portion and the first rod to define a hand grip area.

9. The apparatus of claim 5, wherein the netting portion includes a semi-rigid to rigid device proximate at least one edge of the netting portion.

10. The apparatus of claim 5, wherein the netting portion includes a selectively closable pocket-like storage device suitably affixed to the netting portion.

11. A carrier apparatus and a holding device for the carrier apparatus, comprising in combination:

a carrier apparatus comprising a first rod, a second rod, a first strap connecting the first and second rods, and a second strap connecting the first and second rods, wherein the carrier apparatus is in a carrying position when the first rod is placed under and then above the second rod to form two self-tightening nooses from the first and second straps; and a holding device for holding the carrier apparatus in an open position to receive objects, the holding device comprising a generally U-shaped structure, wherein the carrier apparatus rests upon the generally U-shaped structure to hold the carrier apparatus in the open position.

12. The apparatus and device of claim 11, wherein the generally U-shaped structure includes rod engaging elements proximate a top portion of the U-shaped structure.

13. A carrier apparatus comprising:

a first rod;

a second rod;

a first strap connecting the first and second rods;

a second strap connecting the first and second rods;

wherein the carrier apparatus is in a carrying position when the first rod is placed under and then above the second rod to form two self-tightening nooses from the first and second straps; and a securing device selectively preventing the nooses from loosening, wherein the securing device comprises at least one hook attached to the first rod and a plurality of cross-straps spanning between the first and second straps, and wherein the at least on hook selectively engages one of the plurality of cross-straps.

* * * * *